United States Patent [19]

Widmer

[11] 4,201,372

[45] May 6, 1980

[54] BLAST FURNACE TUYERE

[75] Inventor: Colin F. Widmer, Cleveland, England

[73] Assignee: James Brown & Sons Limited, Cleveland, England

[21] Appl. No.: 37,292

[22] Filed: May 9, 1979

[30] Foreign Application Priority Data

May 23, 1978 [GB] United Kingdom ..... 21693/78

[51] Int. Cl.[2] ..... C21B 7/10

[52] U.S. Cl. ..... 266/270

[58] Field of Search ..... 266/270, 193

[56] References Cited

U.S. PATENT DOCUMENTS 4,140,302 2/1979 Lynch ..... 266/270

*Primary Examiner*—M. J. Andrews

[57] ABSTRACT

A tuyere is disclosed with a partition blocking the direct path between the inlet and outlet orifices (16,18) in the main cooling chamber (14). Guide members (30,32) extend from the far side (from the partition) of the orifices (16,18) towards but not reaching the nose-end wall of the cooling chamber (14). Therefore whichever orifice (16,18) is used as the inlet for cooling fluid, a fast moving stream is ensured at the nose end of the chamber (14) near the partition. This assists the cooling of the tuyere in this area, which otherwise tends to form a marked hotspot, especially when the inlet and outlet orifices (16,18) are close together.

3 Claims, 3 Drawing Figures

BLAST FURNACE TUYERE

FIELD OF THE INVENTION

This invention relates to tuyeres for blast furnaces.

BACKGROUND OF THE INVENTION

Such tuyeres are provided with a water jacket for cooling purposes. At one time, the water jacket consisted of a single chamber, but in more recent times separate cooling has been provided for the nose of the tuyere, either by means of a pipe for cooling water embedded in the nose or by means of a separate chamber in front of the main chamber of the tuyere.

In use a tuyere is located more or less horizontally through the wall of the blast furnace, and there is often a demand for all the tubes for cooling water to be located at the upper part of the rear of the tuyere between the 10 o'clock and 2 o'clock positions. This offers no particular difficulty as regards the water supply to the nose of the tuyere, where such a separate supply is provided, as is usually the case, but there is some difficulty in getting a good circulation of water at the front end (i.e. the nose end) of the main chamber at the 12 o'clock position.

Furthermore, the pipework in many furnaces is alternately left hand and right hand for each tuyere around the furnace so that ideally the inlet and outlet to the nose (if separately cooled) and the inlet and outlet to the main chamber should be reversible. There is no problem in doing this on the nose circuit, if it is simply a loop of tube, but it is impossible for the present designs to obtain good circulation in the main chamber at the 12 o'clock position when the water flow is reversed.

SUMMARY OF THE INVENTION

The present invention aims to improve the circulation of cooling water in the main chamber of a tuyere, and to provide a construction where the inlet and outlet to the main chamber are reversible, so that either orifice may be used for the inlet, the other one being then the outlet for the cooling water.

According to the present invention we provide a tuyere for a blast furnace having a nose and a rear end, a cooling chamber of annular cross-section with inner and outer walls, a first end wall towards the nose of the tuyere and a second end wall at the rear of the tuyere, inlet and outlet orifices in the second end wall through which cooling fluid may be passed into and out of the said chamber, a partition within the said chamber which runs the axial length of the said chamber and extends between the said inner and outer walls and which is located such that there is one said orifice each side of the said partition, and a guide member on each side of the said partition extending within the chamber from the said second end wall towards but not reaching the first end wall, being so located that each orifice is between the said partition and a said guide member, the forward end of each guide member terminating adjacent the partition whereby fluid entering by a said orifice is guided into a stream which reaches that part of the said chamber which is near to both the said partition and the said first end wall.

Where, as will usually be the case, the nose is separately cooled, the partition may suitably be provided by a rib on opposite sides of one of the tubes of the water supply to the nose.

DESCRIPTION OF PREFERRED EMBODIMENTS

Figure 1:
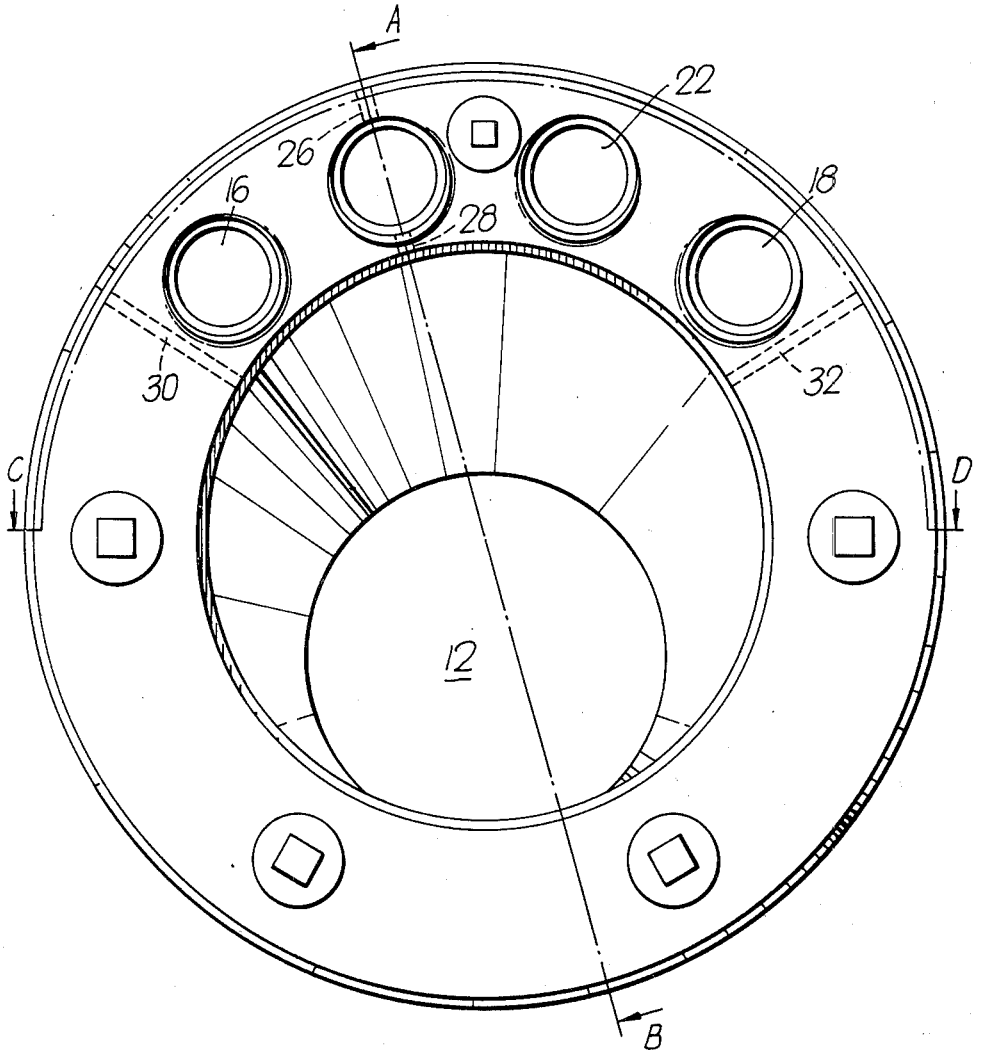
FIG. 1 is an end view of one form of tuyere according to the present invention.

As shown in the drawings, the tuyere consists of a copper casting, providing a central passage 12 for the air blast and a surrounding water jacket having a main water chamber 14.

FIG. 1 shows four orifices 16,18,20,22 for cooling water. The orifices 20,22 provide cooling water for the nose 15 of the tuyere through a looped tube 24, which may be a thin stainless steel tube cast into the copper at the nose and the rear end 17 of the tuyere, and passing through the water chamber 14. The other orifices 16,18 lead directly into the chamber 14 and provide cooling water for this chamber.

Figure 2:
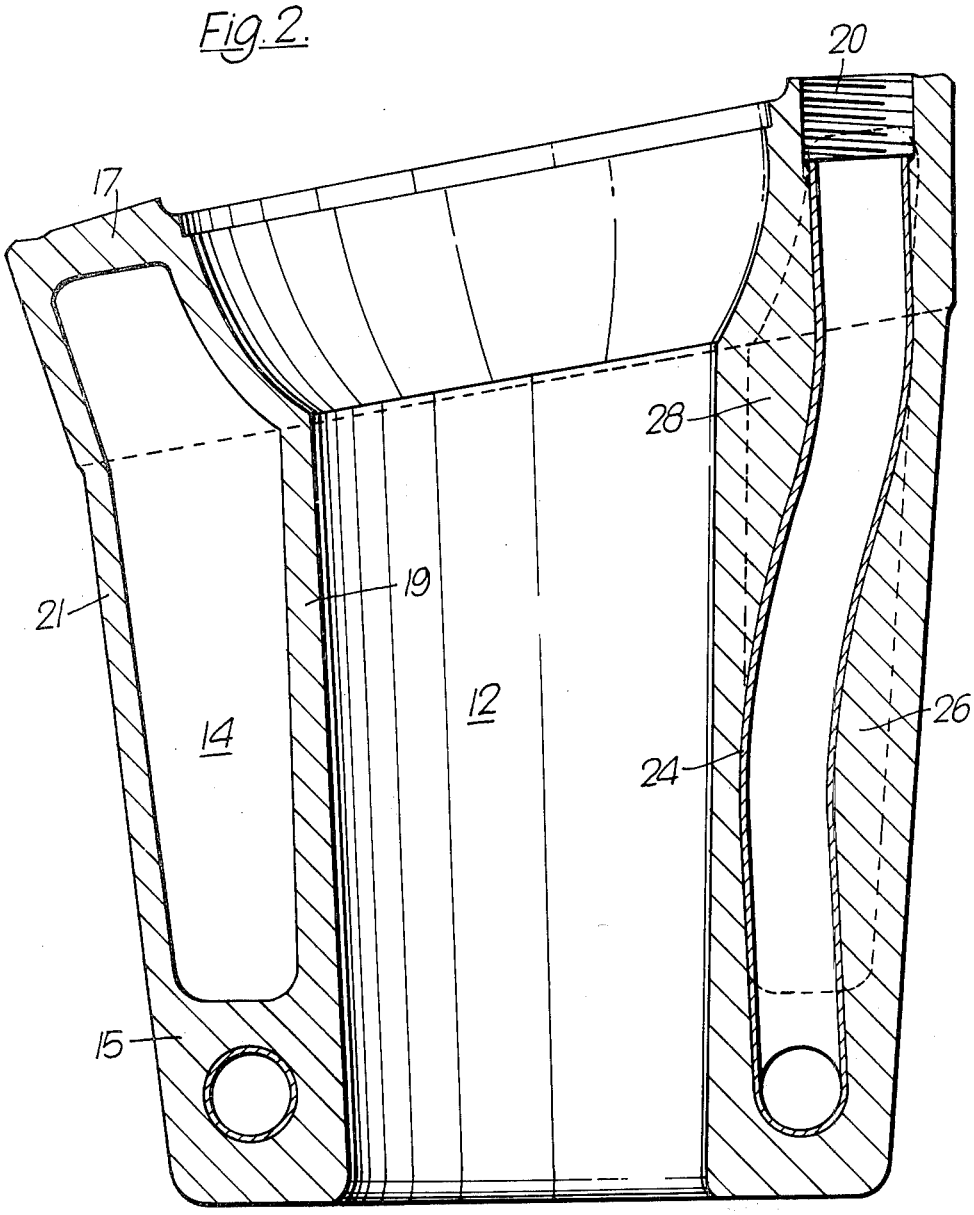
FIG. 2 is a section along the line AB of FIG. 1.

A partition is formed from two webs 26,28 which extend (as seen in FIG. 1) above and below one length of the tube 24 and between the inner and outer walls 19,21, and which (as best seen in FIG. 2) blocks off the whole chamber 14, so that no water can travel directly between the orifices 16,18 without passing round the chamber.

Two guide members 30,32 (see particularly FIG. 3) are provided in the casting for directing water to and from the orifices 16,18. These guide members which, like the partition, are formed as webs in the casting, extend across the chamber 14 between the inner and outer walls. The position of the upper ends of the webs are shown in broken lines in FIG. 1.

The guide member 30 directs any stream of water entering through orifice 16 into a path which terminates short of the partition formed by the webs 26,28 and short of the front end of the main chamber. The guide member 32 likewise directs any stream of water entering through orifice 18 into a path which terminates short of the partition and short of the front end of the main chamber. The reason for the difference of shape of the guide members 30,32 is that the partition is not centrally between the orifices 16,18 and the guide member 32 must therefore give the water some degree of lateral movement to bring it adjacent the partition.

Figure 3:
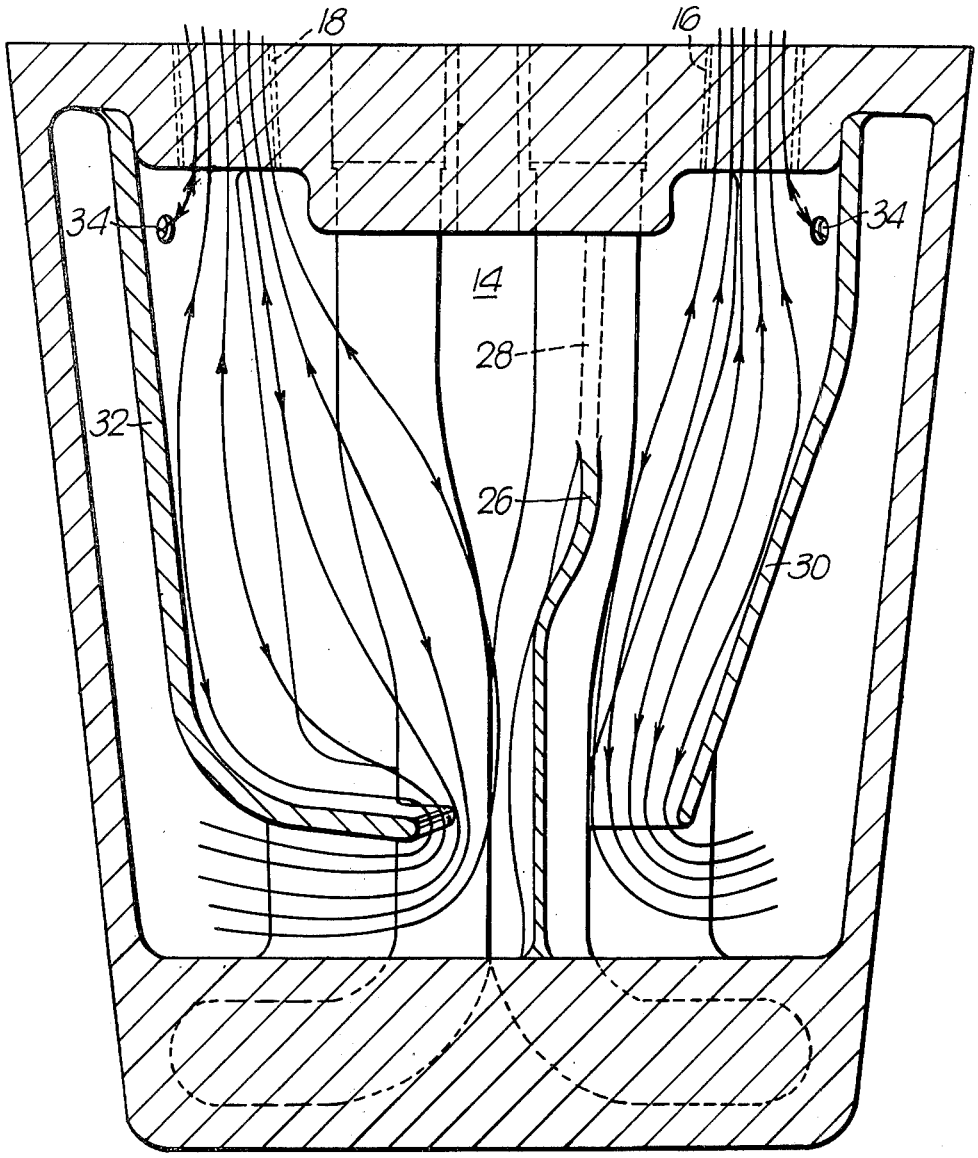
FIG. 3 is an exposed view along the line CD of FIG. 1 i.e. with the outer wall removed.

The flow of water can be seen from FIG. 3. If orifice 16 is being used as the inlet, the water enters with relatively high velocity which reduces as it flows through the larger section of the chamber, but increases again as it passes round the end of the guide member 30. To reach the outlet orifice 18 a large bulk of the water passes round the end of the guide member 32 which causes it to accelerate, as shown by the flow lines on the drawing. Holes 34 may be located in the upper part of the guide members 30,32 to take a proportion of the cooling water into and from the rear end of the chamber.

It will be clear that, if the flow of water is reversed, it will be the guide member 32 which leads the incoming water into the forward end of the chamber and the guide member 30 which guides the returning water. In either case the water is accelerated in the critical area at the 12 o'clock position immediately behind the nose.

If the tuyere were of the type without a separately cooled nose, the partition could of course be made by a web passing right across the main chamber.

I claim:

1. A tuyere for a blast furnace having a nose and a rear end, a cooling chamber of annular cross-section with inner and outer walls, a first end wall towards the nose of the tuyere and a second end wall at the rear of the tuyere, inlet and outlet orifices in the second end wall through which cooling fluid may be passed into and out of the said chamber, a partition within the said chamber which runs the axial length of the said chamber and extends between the said inner and outer walls and which is located such that there is one said orifice each side of the said partition, and a guide member on each side of the said partition extending within the chamber from the said second end wall towards but not reaching the first end wall being so located that each orifice is between the said partition and a said guide member, the forward end of each guide member terminating adjacent the partition whereby fluid entering by a said orifice is guided into a stream which reaches that part of the said chamber which is near to both the said partition and the said first end wall.

2. A tuyere according to claim 1 in which there are additional means for cooling the nose of the said tuyere with at least one conduit running through the said chamber to the said nose, the said partition being formed by the provision of webs extending between the said conduit and the said outer wall and between the said conduit and the said inner wall.

3. A tuyere according to claim 1 in which each said guide member has at least one hole through it near the said second end wall.

* * * * *